US005564675A

United States Patent [19]

Hill, Jr. et al.

[11] Patent Number: 5,564,675

[45] Date of Patent: Oct. 15, 1996

[54] SUBSURFACE SAFETY VALVE OF MINIMIZED LENGTH

[75] Inventors: Thomas G. Hill, Jr., Kingwood; Winfield M. Sides, III; Billy R. Newman, both of Houston, all of Tex.

[73] Assignee: Camco International Inc., Houston, Tex.

[21] Appl. No.: 325,782

[22] Filed: Oct. 19, 1994

[51] Int. Cl.[6] ..... E21B 34/12

[52] U.S. Cl. ..... 251/62; 251/89; 166/321; 166/323

[58] Field of Search ..... 166/321, 323, 166/325; 251/62, 63.4, 89; 137/219

[56] References Cited

U.S. PATENT DOCUMENTS

| | | | |
|---|---|---|---|
| 3,724,501 | 4/1973 | Scott | 251/250 |
| 3,799,258 | 3/1974 | Tausch | 166/72 |
| 3,958,633 | 5/1976 | Britch et al. | 166/321 |
| 4,161,219 | 7/1979 | Pringle | 166/324 |
| 4,252,197 | 2/1981 | Pringle | 166/322 |
| 4,411,316 | 10/1983 | Carmody | 166/323 X |
| 4,574,889 | 3/1986 | Pringle | 166/323 X |
| 4,576,358 | 3/1986 | Mott et al. | 251/62 |
| 4,577,694 | 3/1986 | Brakhage, Jr. | 166/323 X |
| 4,860,991 | 8/1989 | Blizzard et al. | 251/62 X |
| 4,926,945 | 5/1990 | Pringle et al. | 166/321 |
| 5,159,981 | 11/1992 | Le | 166/325 |
| 5,411,096 | 5/1995 | Akkerman | 251/63.4 X |

*Primary Examiner*—Edward K. Look
*Assistant Examiner*—Michael S. Lee

[57] ABSTRACT

A subsurface safety valve of minimized length comprises a tubular valve housing with a valve closure member therein movable between an open and a closed position, an axially shiftable flow tube for opening the valve closure member, a plurality of longitudinally disposed springs radially spaced about the housing for biasing the flow tube to a closed position, and a piston and cylinder assembly to move the flow tube to an open position, with a portion of the assembly longitudinally overlapping at least one of the springs. The safety valve includes simple mechanisms to lock out the safety valve, and to establish secondary hydraulic communication with a wireline set secondary valve set within the locked out safety valve.

18 Claims, 2 Drawing Sheets

10
12
14
16
18
20
22
24
26
28
30
32
34
36
38
40
42
44
46

10
12
14
16
18
22
24
28
30
32
36
38
40
44
46
A
A

SUBSURFACE SAFETY VALVE OF MINIMIZED LENGTH

BACKGROUND OF THE INVENTION

1. Field of the Invention

The present invention relates to a subsurface safety valve and, more particularly, to a subsurface safety valve of minimized length.

2. Description of Related Art

Subsurface safety valves are used within wellbores to prevent the uncontrolled escape of wellbore fluids, which if not controlled could directly lead to a catastrophic well blowout. Certain styles of safety valves are called flapper type valves because the valve closure member is in the form of a circular disc, as disclosed in U.S. Pat. No. 3,799,258, or in the form of a curved disc, as disclosed in U.S. Pat. No. 4,926,945. These flappers are opened by the application of hydraulic pressure to a piston and cylinder assembly, as is disclosed in U.S. Re. Pat. No. B1 4,161,219, to move a flow tube against the flapper. The flow tube is biased by a helical spring in a direction to close the flapper in the event that hydraulic fluid pressure is reduced or lost.

These types of valves are relatively expensive to manufacture due partly to the overall dimensions of the valve and its internal components. There is a need to reduce the costs of such valves, and one method of reducing the cost is to reduce the valve's overall length, and thereby reduce the raw material and labor requirements. The minimum length of a safety valve is dictated by the distance the flow tube must be moved to open the flapper and to permit the flapper to close. The flow tube's distance of movement, known as its "stroke", is cumulative in that its distance must be repeated throughout the safety valve as space must be provided within the safety valve's housing for the flow tube's displacement in both the open and closed position, the length of the piston in the open and closed position, and the required length of the compressed spring. This results in a minimum length of at least three stroke lengths, plus the height of the compressed spring.

U.S. Pat. No. 4,860,991 discloses a safety valve with minimized length by locating the piston and cylinder assembly parallel with and alongside the power spring, so that the minimum valve length is two stroke lengths. While this safety valve design provides a beneficial length reduction and thereby a cost reduction there is a need for a safety valve with a further reduced length, as well as a minimized outside diameter but still with a longitudinal bore of a maximized internal diameter. The bore's internal diameter is reduced when a safety valve of this style is designed with a reduced outside diameter, because the safety valve's housing does not have sufficient space to accommodate the thickness of the power spring, the thickness of the piston assembly, the thickness of the flapper, the wall thickness of the housing, and still have a bore of a standard internal diameter for a given tubing size.

The length of a safety valve can also be effected when means are incorporated to lock out the valve and establish secondary hydraulic communication. To "lock out" a safety valve is a term well known to those skilled in the art, and is defined as the ability to temporarily or permanently lock the safety valve's flapper in an open position. A safety valve is locked out when the safety valve fails, such as the seals have failed, or during well workover operations. Once a safety valve is locked out, a secondary or wireline retrievable inset valve is sealably set inside of the longitudinal bore of the safety valve, as described in U.S. Pat. No. 4,252,197, or within a hydraulic communication nipple, and the existing hydraulic control line is used to operate the inset valve.

Previous mechanisms to lock out a safety valve and establish the secondary hydraulic communication pathways added additional length to the safety valve and/or increased the mechanical complexity of the safety valve, thereby increasing the cost of the safety valve.

SUMMARY OF THE INVENTION

The present invention has been contemplated to overcome the foregoing deficiencies and meet the above described needs. Specifically, the present invention is a subsurface safety valve of minimized length, of minimized outside diameter, with a minimized number of components, and with longitudinal opening of standard internal diameter for a given tubing size. The valve comprises a tubular valve housing with a valve closure member therein movable between an open and a closed position, and an axially shiftable flow tube disposed within the housing for opening the valve closure member. In place of a single power spring, a plurality of relatively small diameter, longitudinally disposed springs are radially spaced about the housing for biasing the flow tube to a closed position. A piston and cylinder assembly engages and moves the flow tube to an open position, with a portion of the assembly longitudinally overlapping at least one of the springs. With this overlapping arrangement, a subsurface safety valve is provided with minimized length, minimized outside diameter, a standard internal diameter, as well as minimized cost.

Additionally, the safety valve includes an extremely simple and effective mechanism to lock out the safety valve and establish secondary hydraulic communication with a wireline set secondary valve. When such a secondary valve is to be set within the safety valve, a wireline impact tool forces the flow tube to move past shearable pins, which in turn causes the piston is withdrawn from the cylinder. This design precludes reentry of the piston into the cylinder, therefore the flow tube cannot be moved and so the flapper is locked in the open position. Since the piston is withdrawn from the cylinder, hydraulic fluid is permitted to flow into the internal opening of the safety valve and into the operating mechanism of the secondary valve.

DETAILED DESCRIPTION OF THE PREFERRED EMBODIMENTS

Figure 1:
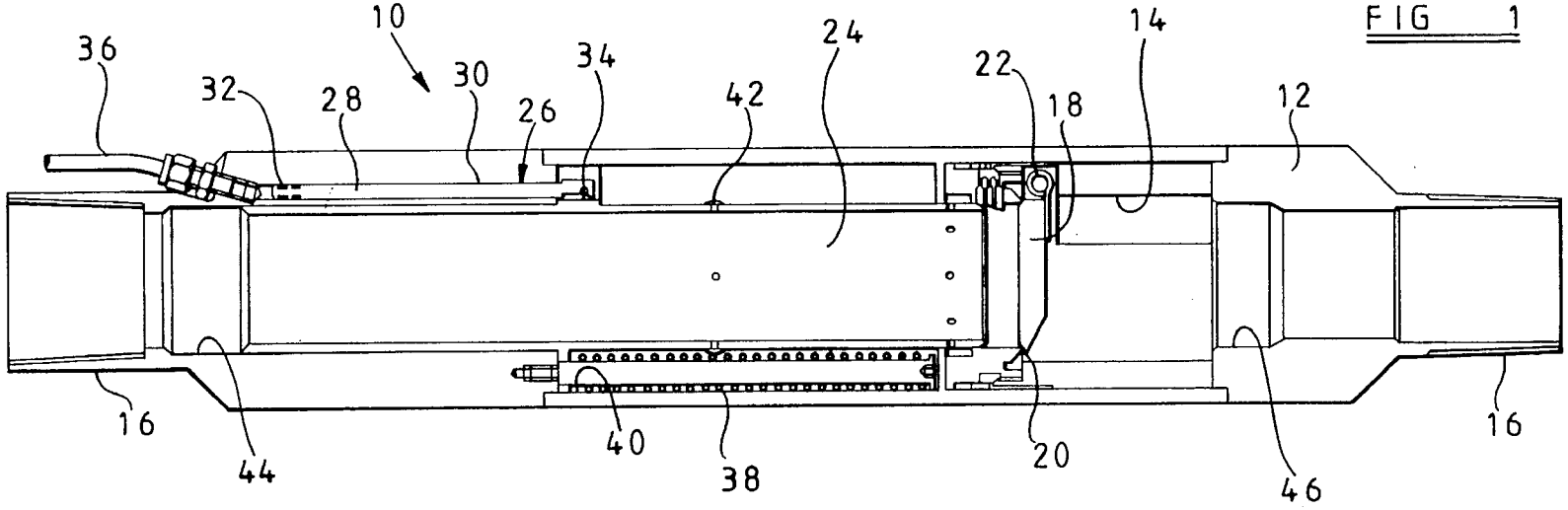
FIG. 1 is a side elevational view in cross-section of one preferred embodiment of a subsurface safety valve of the present invention, with a flow tube therein shown in a retracted or valve-closed position.

As has-been briefly described above, the present invention is a subsurface safety valve of minimized length which comprises a tubular valve housing with a valve closure member therein movable between an open and a closed position, an axially shiftable flow tube for opening the valve closure member, a plurality of longitudinally disposed springs radially spaced about the housing for biasing the flow tube to a closed position, and a piston and cylinder assembly to move the flow tube to an open position, with a portion of the assembly longitudinally overlapping at least one of the springs.

For the purposes of the present discussion the safety valve will be described as a rod piston safety valve of the type disclosed in U.S. Re. certificate Pat. B14,161,219 and U.S. Pat. No. 4,860,991, which are commonly assigned hereto and which are incorporated herein by reference. However, it should be understood that all of the novel features of the present invention to be described in detail below can be beneficially used with other types of commercially available safety valves.

One preferred embodiment of the present invention is shown in FIGS. 1–4 wherein a safety valve 10 comprises a generally cylindrical or tubular housing 12 with a longitudinal opening 14 extending therethrough. At each longitudinal end of the housing 12, connection mechanisms, such as threaded couplings 16, are provided for connecting the housing 12 to a pipe string (not shown), as is well known to those skilled in the art. Within the housing 12 is mounted a valve closure member 18, commonly referred to as a "flapper", which is hingedly mounted within an internal recess in the housing 12. The flapper 18 can be in the form of a generally fiat disk or a curved disk. Further, any other type of valve closure mechanism can be used, such as a laterally moving plug, a rotating ball, and the like.

Figure 2:
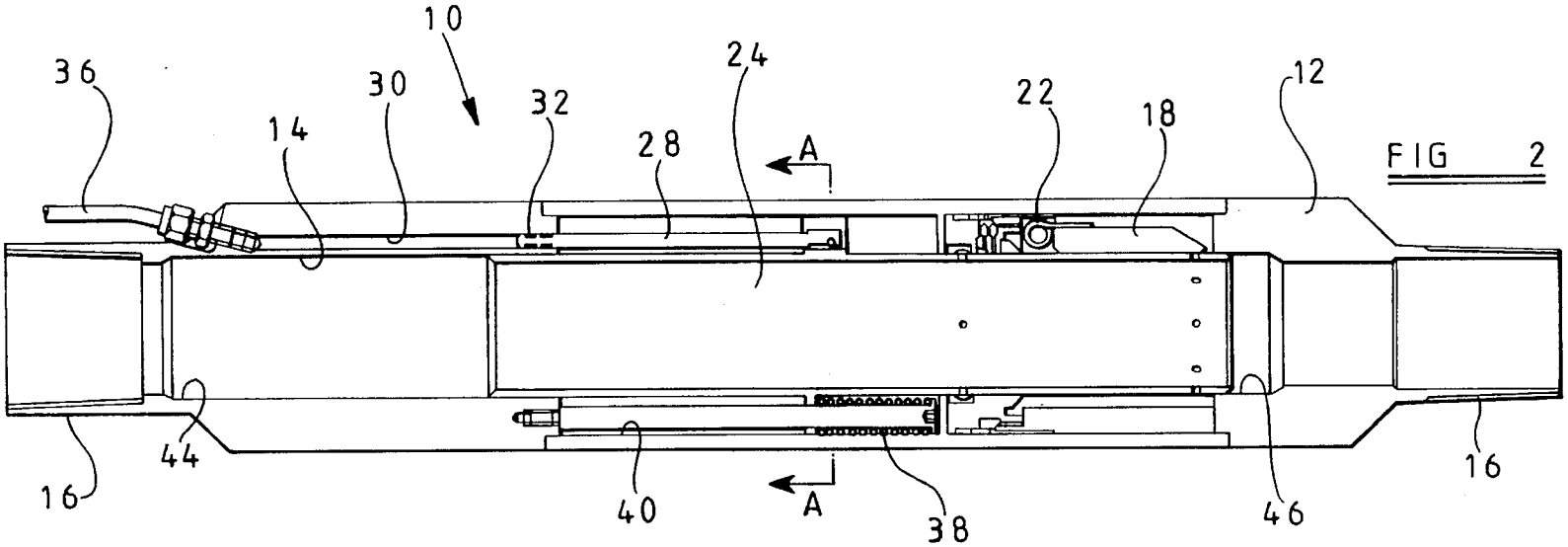
FIG. 2 is a side elevational view in cross-section of the safety valve of FIG. 1 with the flow tube shown in an extended or valve-open position.
Figure 3:
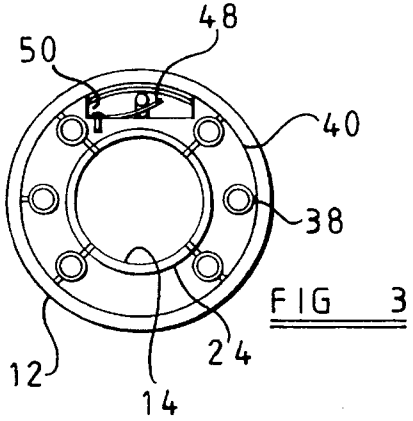
FIG. 3 is a view taken along line A—A of FIG. 2.

The purpose of the valve closure mechanism is to close off and seal the opening 14 to prevent the flow of fluid therethrough. Accordingly, the valve closure member 18 is rotated into a "closed" position, as shown in FIG. 1, and held against annular valve seats 20 by action of a hinge spring 22, as is well known to those skilled in the art. The mechanism that acts upon the flapper 18 to push it into an "open" position, as shown in FIG. 3, is an axially shiftable flow tube 24. The flow tube 24 is forced against the flapper 18 by action of a piston and cylinder assembly 26, which is comprised of an elongated rod or piston 28 axially movable within a cylinder or bore 30 located either outside of or, preferably, within the wall of the housing 12. One or more annular seals 32 are provided on the piston 28 adjacent a first end thereof, and a second end of the piston 28 is pinned or otherwise connected to a ridge 34 on the flow tube 24. Hydraulic operating fluid is provided to the assembly 26 through a conduit 36, that extends to the earth's surface, to move the piston 28 and thereby to force the flow tube 24 against and to open the flapper 18, as shown in FIG. 2, as is well known to those skilled in the art.

The flapper 18 and flow tube 24 will remain in the open position to permit the flow of fluids through the opening 14 as long as hydraulic pressure is maintained through the conduit 36 and against the piston 28. In the event that the seals 32 fail or if the conduit 36 is damaged, the loss of hydraulic fluid pressure will permit the flapper 18 to rotate to a closed position, in this manner the safety valve is considered a fail-safe design. However, the force of the hinge spring 22 on the flapper 18 is usually not sufficient to rotate the flapper 18 to a closed position and to axially move the flow tube 24 and the piston 28.

In order to close the flapper, in the past, a relatively large helical power spring would be disposed coaxially with and on the outside of the flow tube, as shown in U.S. Pat. No. 4,860,991. Also, in place of the single power spring a plurality of parallel helical springs would be radially disposed in the housing around the periphery of the flow tube, as is disclosed in U.S. Pat. No. 4,340,088. In one preferred embodiment of the present invention, a plurality of relatively small diameter, helical springs are used, but with a new adaptation. In the present invention, a portion of the piston and cylinder assembly 26 is located parallel with and longitudinally overlapping at least one of a plurality of radially spaced helical springs 38. The springs 38 are disposed about guide rods and are held within recesses or bores 40 within the housing 12, as shown in FIG. 3. The plurality of relatively small diameter springs costs less than the conventional relatively large single power spring.

The above described arrangement is unique because a portion of the piston and cylinder assembly 26 longitudinally overlaps at least a portion of at least one of the springs 38. Either the piston 26 or the cylinder 30 is disposed at approximately the same longitudinal position of the springs 38. In the preferred embodiment shown in FIGS. 1,2 and 4, the springs 38 are at approximately the same longitudinal position within the housing 12, and are parallel therewith, yet one or more of the springs 38 can be longitudinally displaced as desired. As shown in FIG. 3, the springs 38 and the piston and cylinder assembly 26 are at approximately the same distance from the longitudinal axis of the housing 12, yet this is not a requirement. Further, the springs 38 and the piston and cylinder assembly 26 are evenly spaced apart, yet this also is not a requirement.

With the arrangement of internal components as described above, the overall length of the safety valve is minimized because the piston and cylinder assembly 26 is at approximately the same longitudinal position as the springs 38, and not-displaced longitudinally therefrom. The outside diameter of the housing 12 is minimized while still maintaining the opening's 14 diameter a large as possible for a given tubing size by locating the piston and cylinder assembly 26 at approximately the same radial distance from the longitudinal axis of the housing 12 as the springs 38, and not offset outwardly therefrom.

The overall operation of the safety valve 10 is conventional in that hydraulic fluid conveyed through the conduit 36 moves the piston 28 towards a second end of the housing 12. The piston 28 moves the flow tube 24 against and thereby opens the flapper 18, as is shown in FIG. 2. The flapper 18 will kept in the open position as long as sufficient hydraulic pressure is maintained to overcome the force of the valve closure springs 38.

Figure 4:
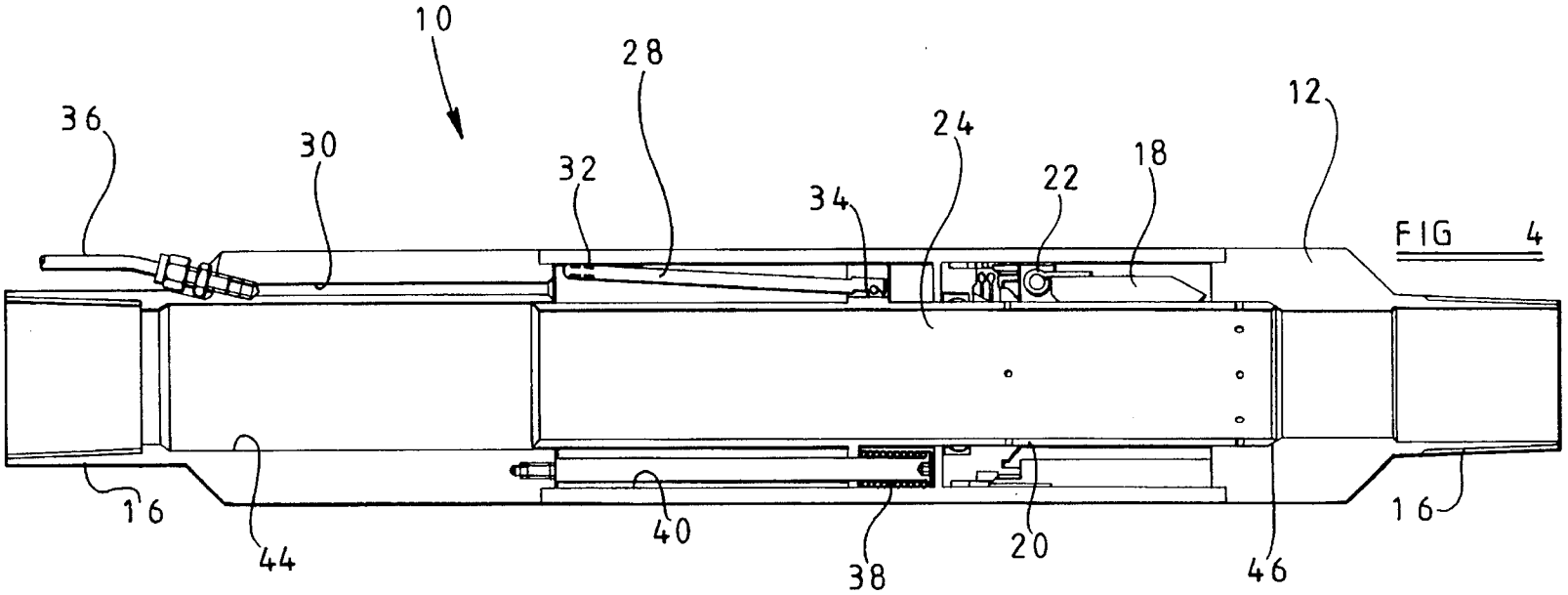
FIG. 4 is a side elevational view in cross-section of the safety valve of FIG. 1 with the flow tube shown in a fluid-bypass or "locked out" position.

In the event that the wellbore below the safety valve 10 needs to be worked over, or if the safety valve 10, there is a need to lock out the safety valve. The term to "lock out" a safety valve is a term well known to those skilled in the art, and is defined as the ability to temporarily or permanently lock the safety valve's flapper in an open position. The present invention is provided with a simplified mechanisms to lock out the valve. In one preferred embodiment of the safety valve 10, the lower end of the flow tube 24 is moved through the opening 14 to an "open" position and then past the flapper 18, to partially protect it from sand buildup. The piston and cylinder assembly 26 will move the flow tube 24 until a lower end thereof or the annular ridge 34 encounters one or more shearable stop pins 42, which extend partway into the opening 14. The pins 42 are designed and selected to that the maximum force generated by hydraulic pressure exerted on the piston 28 is not sufficient to shear or break the pins 42. A wireline conveyed jar or shifting tool (not shown) is inserted into the opening 14 of the safety valve housing 12 and landed within an annular recess or ridge 44 within the longitudinal bore of flow tube 24. Also, the jar or shifting tool can act upon an exposed first or "upper" end of the flow tube 24. With the jar or shifting tool, sufficient force is exerted upon the flow tube 24 to force it longitudinally or "downwardly" to open the flapper 18, as shown in FIG. 2, and then therepast to shear the pins 42. The flow tube 24 will continue to move within the bore 14 until a second or "lower" end thereof contacts an annular ridge 46 within the opening 14, as shown in FIG. 4.

The lengths of the piston 28 and of the cylinder 30, and the distance the flow tube 24 must move between the shear pins 42 and the ridge 44 are all selected so that when the flow tube 24 is moved past the pins 42, the first end of the piston 28 will be withdrawn from the cylinder 30. To prevent the piston 28 from reentering the cylinder 30, a leaf spring 48 (as shown in FIG. 3) is mounted transversely to the longitudinal axis of the housing 12 and within an annular recess=50 in the housing 12. The spring 48 forces the first end of the piston 28 out of coaxial alignment with the cylinder 30. Since the piston 28 cannot move, the flow tube 24 cannot move, and so the flapper 18 is locked out.

Once the piston 28 has been withdrawn from the cylinder 30, hydraulic fluid can then freely pass through the open cylinder 30 into the opening 14 or, alternatively, through the bores/recesses 40 and/or 50 and then into the opening 14 to provide a passage for hydraulic fluid for use in the operation of the wireline conveyed inset valve, as is well know to those skilled in the art.

Whereas the present invention has been described in particular relation to the drawings attached hereto, it should be understood that other and further modifications, apart from those shown or suggested herein, may be made within the scope and spirit of the present invention.

What is claimed is:

1. A subsurface safety valve comprising:

a tubular valve housing;

a valve closure member movable between an open and a closed position;

an axially shiftable flow tube for opening the valve closure member;

a plurality of longitudinally disposed springs approximately equally radially spaced about the housing for biasing the flow tube to a closed position; and a piston and cylinder assembly to move the flow tube to an open position, a portion of the assembly longitudinally overlaps at least one of the springs.

2. A subsurface safety valve of claim 1 wherein the plurality of springs are in parallel and longitudinally overlapping relationship.

3. A subsurface safety valve of claim 1 wherein the plurality of springs are in longitudinally overlapping relationship.

4. A subsurface safety valve of claim 1 wherein the plurality of springs are retained within a wall of the housing.

5. A subsurface safety valve of claim 1 wherein the plurality of springs and the portion of the piston assembly are in longitudinally overlapping relationship.

6. A subsurface safety valve of claim 1 wherein the plurality of springs and the assembly are approximately equally radially spaced about the housing.

7. A subsurface safety valve of claim 1 wherein the flow tube is movable to a fully extended position where the piston is withdrawn from the cylinder to lock out the safety valve.

8. A subsurface safety valve of claim 7 wherein when the piston is withdrawn from the cylinder, a passage is opened between the interior of the cylinder and a longitudinal opening extending through the housing.

9. A subsurface safety valve comprising:

a tubular valve housing having a longitudinal opening therethrough;

a valve closure member movable between an open and a closed position to alternately permit and prevent fluid flow through the opening;

an axially shiftable flow tube for opening the valve closure member;

means for biasing the flow tube to a closed position;

a piston and cylinder assembly to move the flow tube to an open position; and the flow tube being movable to a fully extended position where the valve closure member is locked in the open position; and shearable stops in the housing for preventing the flow tube from moving from the open position to the fully extended position until sufficient force is exerted upon the flow tube to shear the shearable stops.

10. A subsurface safety valve of claim 9 wherein when the flow tube is moved to the fully extended position, the piston is withdrawn from the cylinder to lock out the safety valve.

11. A subsurface safety valve of claim 10 wherein as the piston is withdrawn from the cylinder, a passage is opened to permit operating fluid to enter the longitudinal bore.

12. A subsurface safety valve of claim 10 wherein the piston includes a member to prevent the piston from reentering the cylinder.

13. A subsurface safety valve of claim 9 wherein the piston and cylinder are contained within a wall of the housing.

14. A subsurface safety valve of claim 9 wherein the means for biasing the flow tube further comprises a plurality of longitudinally disposed springs radially spaced about the housing.

15. A subsurface safety valve of claim 14 wherein a portion of the assembly longitudinally overlaps at least one of the springs.

16. A subsurface safety valve of claim 15 wherein the plurality of springs and the portion of the assembly are in longitudinally overlapping relationship.

17. A subsurface safety valve of claim 14 wherein the plurality of springs and the assembly are approximately equally radially spaced about the housing.

18. A subsurface safety valve comprising:

a tubular valve housing having a longitudinal opening therethrough;

a valve closure member movable between an open and a closed position to alternately permit and prevent fluid flow through the opening;

an axially shiftable flow tube for opening the valve closure member;

a plurality of longitudinally disposed springs radially spaced about the housing for biasing the flow tube to a closed position;

a piston and cylinder assembly to move the flow tube to an open position, a portion of the assembly longitudinally overlaps at least one of the springs; and the flow tube being movable to a fully extended position to lock the valve closure member in the open position and to open an operating fluid passage between the cylinder and the longitudinal opening.

* * * * *